US007624689B2

(12) United States Patent
Shuert

(10) Patent No.: US 7,624,689 B2
(45) Date of Patent: Dec. 1, 2009

(54) ONE WAY PLASTIC PALLET

(75) Inventor: Lyle H. Shuert, Bloomfield Hills, MI (US)

(73) Assignee: Shuert Technologies, Inc., Sterling Heights, MI (US)

( * ) Notice: Subject to any disclaimer, the term of this patent is extended or adjusted under 35 U.S.C. 154(b) by 463 days.

(21) Appl. No.: 11/514,496

(22) Filed: Sep. 1, 2006

(65) Prior Publication Data

US 2008/0053341 A1 Mar. 6, 2008

(51) Int. Cl.
*B65D 19/38* (2006.01)

(52) U.S. Cl. ..... 108/57.25; 108/901

(58) Field of Classification Search ..... 108/51.11, 108/901, 57.25–57.28, 57.33, 52.1; 206/386, 206/596–600

See application file for complete search history.

(56) References Cited

U.S. PATENT DOCUMENTS

| | | | | | |
|---|---|---|---|---|---|
| 2,973,931 | A | * | 3/1961 | Brown | 108/53.3 |
| 3,696,761 | A | * | 10/1972 | Brown | 108/53.3 |
| 4,408,544 | A | * | 10/1983 | Haataja | 108/53.3 |
| 4,606,278 | A | | 8/1986 | Shuert | 108/908 |
| 4,742,781 | A | * | 5/1988 | Shuert | 108/53.3 |
| 4,930,632 | A | * | 6/1990 | Eckert et al. | 206/386 |
| 5,042,396 | A | | 8/1991 | Shuert | 108/51.1 |
| 5,401,347 | A | * | 3/1995 | Shuert | 156/245 |
| 5,404,829 | A | | 4/1995 | Shuert | 108/51.1 |
| 5,555,820 | A | | 9/1996 | Shuert | 108/51.1 |
| 5,676,064 | A | | 10/1997 | Shuert | 108/55.1 |
| 5,794,544 | A | | 8/1998 | Shuert | 108/57.25 |
| 5,950,545 | A | | 9/1999 | Shuert | 108/53.3 |
| D417,539 | S | * | 12/1999 | Koskinen | D34/38 |
| 6,382,108 | B1 | * | 5/2002 | Stanek et al. | 108/55.1 |
| 6,959,650 | B2 | * | 11/2005 | Greene et al. | 108/57.25 |
| 7,275,489 | B1 | * | 10/2007 | Shuert | 108/57.25 |
| 7,343,865 | B2 | * | 3/2008 | Shuert | 108/57.25 |
| 2005/0000395 | A1 | * | 1/2005 | Apps et al. | 108/57.25 |
| 2006/0075939 | A1 | * | 4/2006 | Shuert | 108/57.25 |

FOREIGN PATENT DOCUMENTS

| | | | |
|---|---|---|---|
| EP | 1914172 | * | 10/2006 |

* cited by examiner

*Primary Examiner*—Janet M Wilkens
(74) *Attorney, Agent, or Firm*—Young Basile

(57) ABSTRACT

A twin sheet plastic pallet comprising an upper plastic sheet and a lower plastic sheet. The upper plastic sheet has a generally planar configuration and includes an upper face defining a platform surface for the pallet and an underface. The lower plastic sheet includes a generally planar main body portion and a plurality of spaced raised portions each including a top wall elevated above the level of the main body portion and fused to the underface of the upper sheet and a plurality of spaced upstanding legs connecting the top wall to the main body portion and defining fork lift passages for the pallet. The lower sheet further includes a plurality of upstanding pillar portions spaced about the periphery of the main body portion and the upper sheet further includes a plurality of downstanding pillar portions spaced about the periphery of the upper sheet main body portion and fused to respective upstanding pillar portions of the lower sheet to form spaced pillar structures. Each downstanding pillar portion is further fused to at least one upstanding leg of the spaced raised portions of the lower sheet. The spaced pillar structures coact with the spaced legs to define forklift passages for the pallet.

15 Claims, 8 Drawing Sheets

ONE WAY PLASTIC PALLET

FIELD OF THE INVENTION

This invention relates to shipping and storage pallets and more particularly to pallets having a plastic construction.

BACKGROUND OF THE INVENTION

Pallets have traditionally been formed of wood. Wood pallets however have many disadvantages. For example, they are subject to breakage and they take up a considerable amount of valuable floor space in the warehouse when they are not in use. They are also difficult to maintain in a sanitary condition, thus limiting their usability in applications where sanitation is important, for example, in food handling application.

In an effort to solve some of the problems associated with wood pallets, plastic pallets have been employed with some degree of success. In one generally successful form of plastic pallet design, a twin sheet construction has been used in which upper and lower plastic sheets are formed in separate molding operations and the two sheets are then selectively fused or knitted together in a suitable press to form a reinforced double wall structure. Whereas these twin sheet plastic pallets are generally satisfactory, they tend to be more expensive than comparable wood pallets and, in particular, their relatively higher cost has precluded their use in one-way applications where the pallet, after fulfilling an initial shipping or material handling assignment, is not reused but rather is destroyed or recycled after the single use.

SUMMARY OF THE INVENTION

This invention is directed to the provision of a plastic pallet which is relatively inexpensive.

More specifically, this invention is directed to the provision of a plastic pallet that is producible at a price that makes the pallet feasible for one-way usage.

This invention relates to a thermoformed twin sheet pallet comprising an upper plastic sheet and a lower plastic sheet, the sheets being fused together to form a platform surface and a plurality of forklift passages.

According to the invention, the upper sheet has a generally planar configuration and includes an upper face defining a platform surface and an underface; the lower sheet includes a generally planar main body portion and a plurality of spaced raised portions each including a top wall elevated above the level of the main body portion and a plurality of spaced upstanding legs connecting the top wall to the main body portion; the top walls of the raised portions of the lower sheet are fused to the underface of the upper sheet; and the forklift passages are defined between the spaced upstanding legs of the raised portions of the lower sheet.

According to a further feature of the invention, the lower sheet further includes a plurality of upstanding pillar portions spaced about the periphery of the main body portion in surrounding relation to the raised portions and the upper sheet includes a main body portion and a plurality of downstanding pillar portions spaced about the periphery of the upper sheet main body portion and fused to respective upstanding pillar portions to form spaced pillar structures.

According to a further feature of the invention, the forklift passages are further defined between the spaced pillar structures.

According to a further feature of the invention, each upstanding pillar portion includes an upstanding side wall and a top wall fused to the underface of the upper sheet and each downstanding pillar portion includes a sidewall fused to the sidewall of a respective upstanding pillar portion and a bottom wall fused to an upper face of the main body portion of the lower sheet.

According to a further feature of the invention, the sidewall of each downstanding pillar portion is further fused to an upstanding leg.

According to a further feature of the invention, each top wall includes a plurality of spaced upstanding bosses and the area of the upper sheet in overlying relation to each top wall includes a plurality of spaced downstanding bosses fused to the upstanding bosses of the respective top wall.

According to a further feature of the invention, each upstanding boss includes a top wall and an annular side wall; each downstanding boss includes a bottom wall and an annular sidewall; the top wall of each upstanding boss is fused to the underface of the upper sheet; the bottom wall of each downstanding boss is fused to an upper face of a top wall of the raised portion; and the side wall of each upstanding boss is fused to the side wall of at least one downstanding boss.

The invention also encompasses a method of forming a twin sheet plastic pallet.

According to an important feature of the invention methodology, a generally planar upper sheet if formed; a lower sheet is formed having a generally planar main body portion and a plurality of raised portions each including a planar top wall spaced above the main body portion and upstanding sidewalls interconnecting the top wall and the main body portion; the top walls of the raised portions are fused to an underface of the upper sheet and portions of the sidewalls are cut away to define openings in the sidewalls defining forklift passages for the pallet.

According to a further feature of the invention methodology, a plurality of upstanding pillar portions are formed spaced about the periphery of the main body portion of the lower sheet in surrounding relation to the raised portions; a plurality of downstanding pillar portions are formed spaced about the periphery of the upper sheet main body portion; and each downstanding pillar portion is fused to a respective upstanding pillar portion to form spaced pillar structures.

According to a further feature of the invention methodology, the pillar structures are spaced such that the spaces between the pillar structures are aligned with the openings in the sidewalls of the raised portions of the lower sheet whereby the forklift passages are defined by the spaces between the pillar structures and the aligned openings in the side walls of the raised portions of the lower sheet.

According to a further feature of the invention methodology, the step of cutting away portions of the sidewalls of the raised portions results in a plurality of upstanding legs connecting the top walls of the raised portions to the main body portion of the lower sheet and the method includes the further step of fusing the sidewall of each downstanding pillar portion to an upstanding leg.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
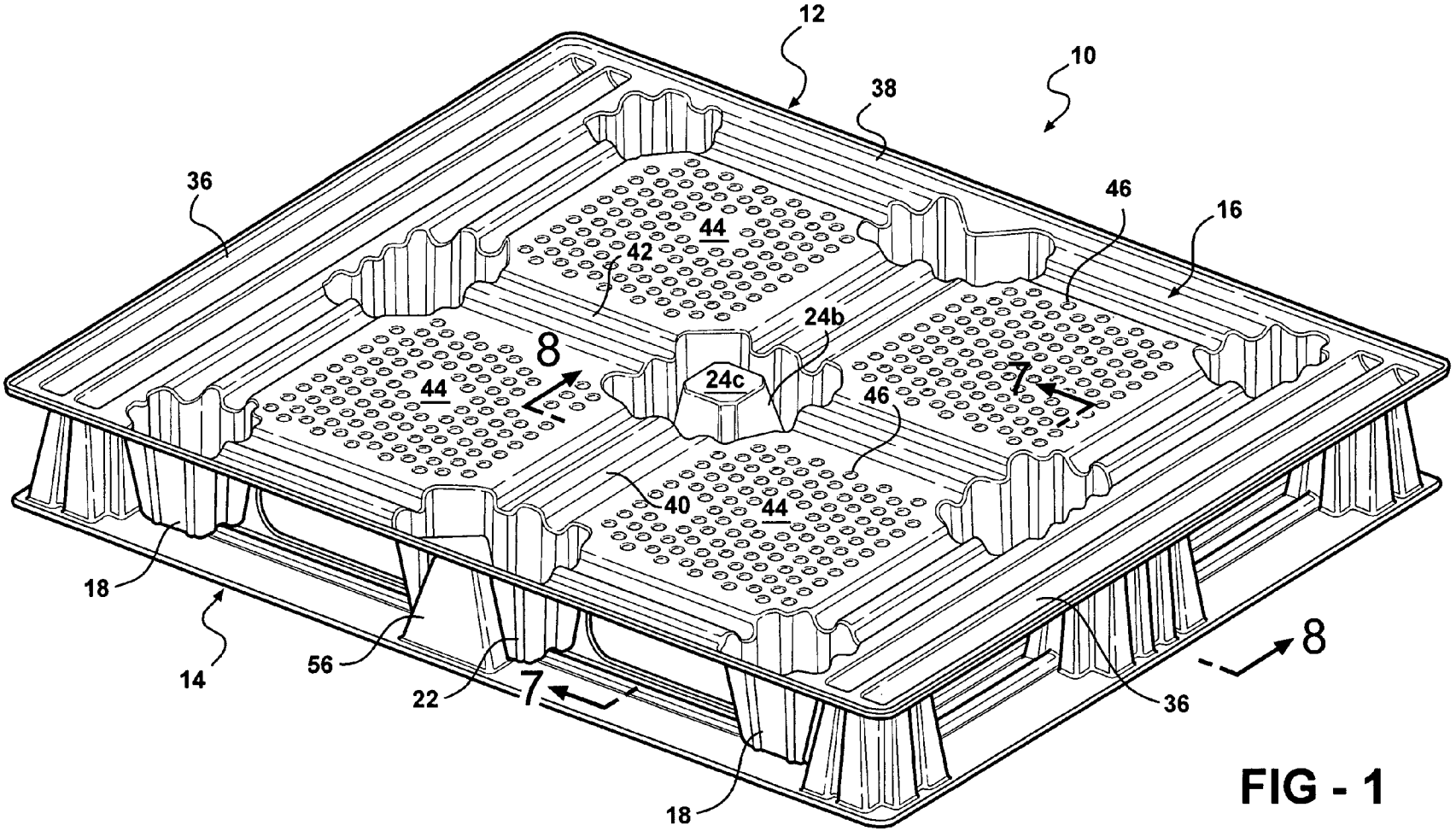
FIG. 1 is a top perspective view of a pallet according to the invention.
Figure 2:
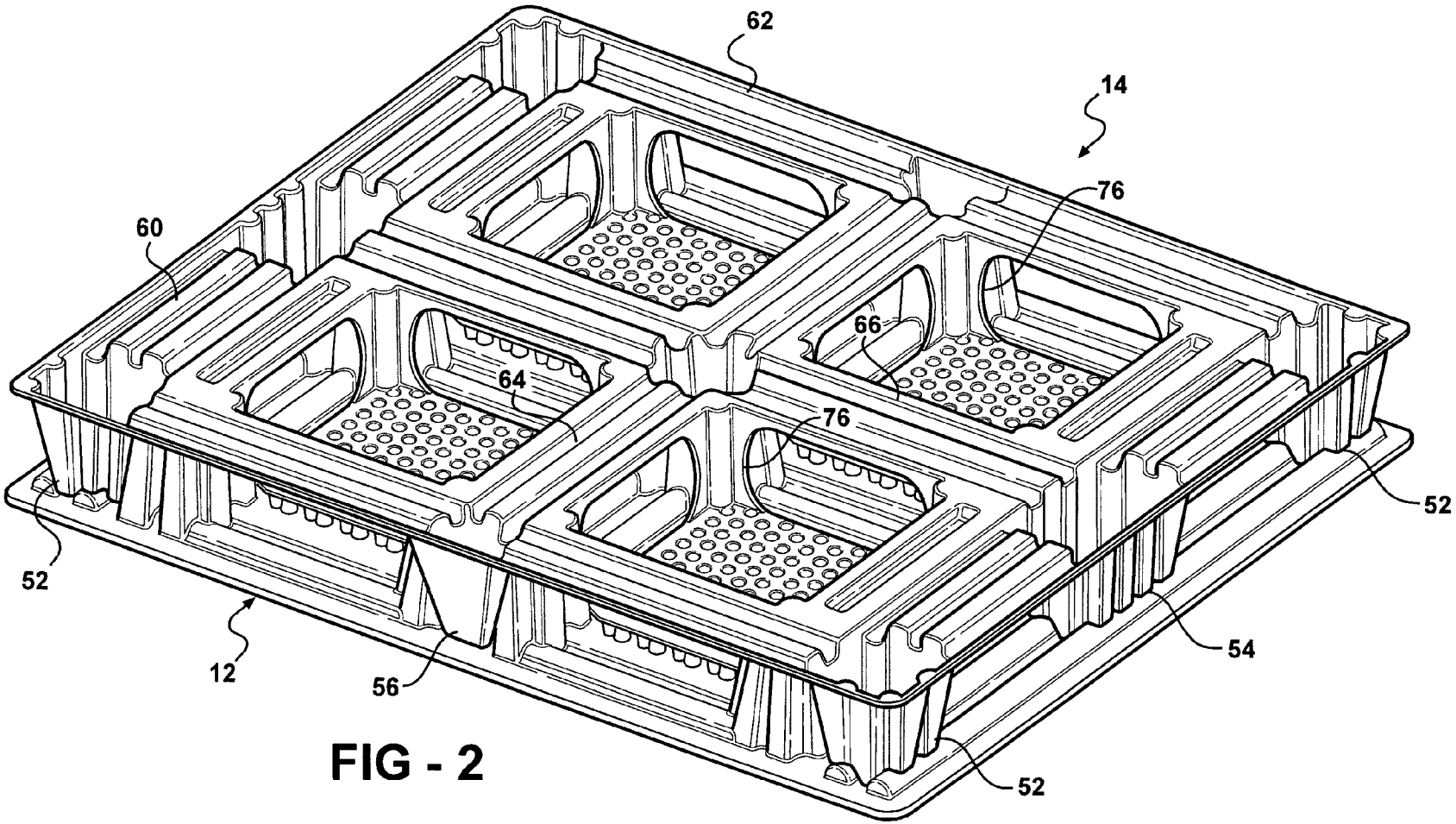
FIG. 2 is a bottom perspective view of the pallet.
Figure 3:
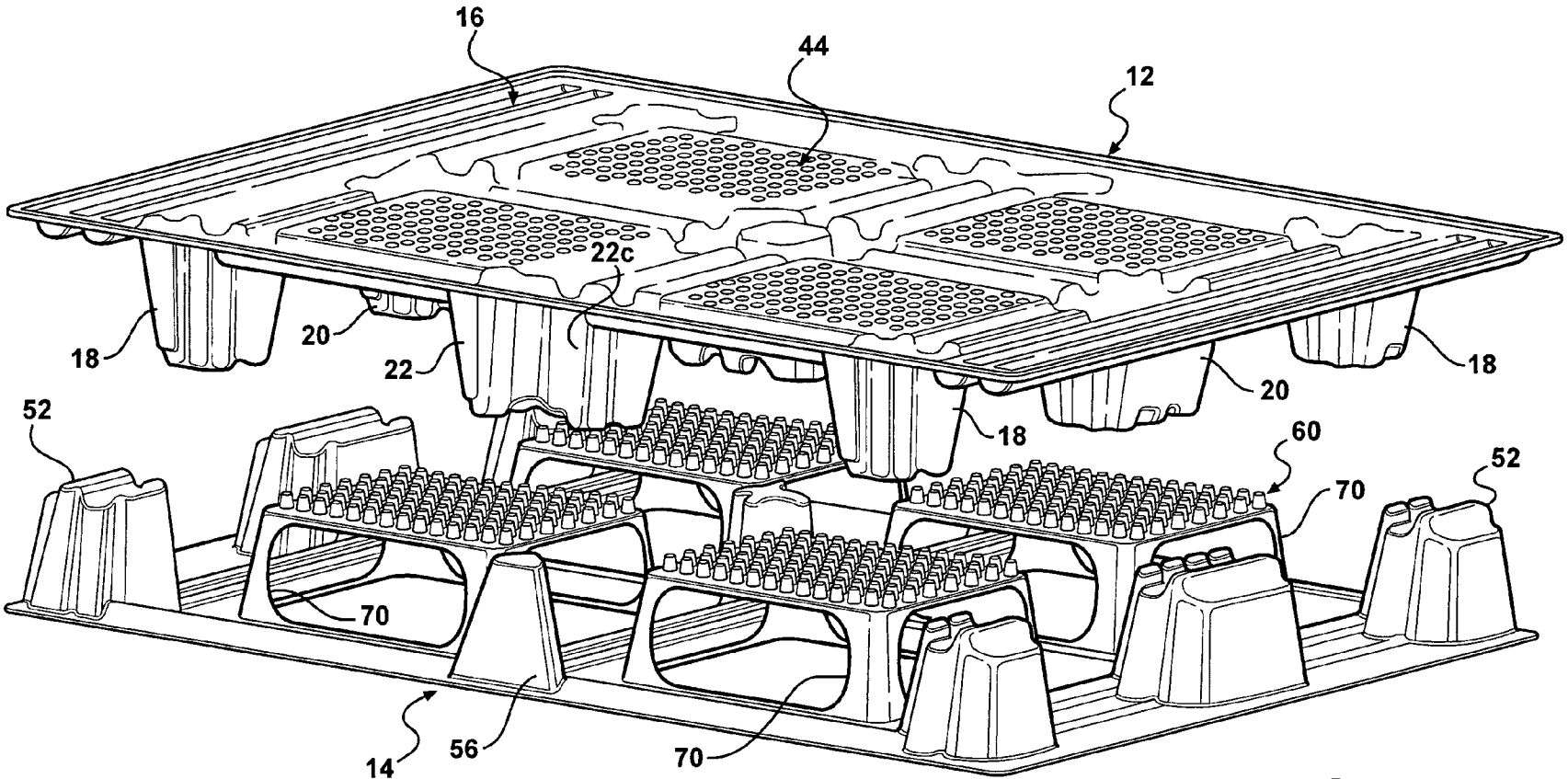
FIG. 3 is a perspective exploded view of the pallet.

The pallet 10 of the invention, broadly considered, comprises an upper generally rectangular plastic sheet 12 and a lower generally rectangular plastic sheet 14. Sheets 12 and 14 are preferably formed of a polyethelene material and may have a thickness of approximately 0.070 inches. In overview, each is formed in a vacuum thermoforming operation and the upper and lower sheets, while still in a heated fusible condition, are brought together to selectively fused portions of the upper sheet to portions of the lower sheet to form the pallet.

Upper sheet 12 includes a main body portion 16, corner pillars 18, intermediate transverse pillars 20, intermediate longitudinal pillars 22, and a central pillar 24.

Main body portion 16 is generally planar and includes transverse peripheral ribs 36, longitudinal peripheral ribs 38, central transverse ribs 40 and central longitudinal ribs 42.

Main body portion 16 further includes rectangular areas 44 defined in the four quadrants of the sheet between the ribs and the pillars. Each area 44 includes a plurality of upwardly opening, downstanding bosses 46 arranged in staggered rows. Each boss 46 includes a top wall 46*a* and an annular sidewall 46*b*.

Each pillar is hollow, opens in the upper face of the main body portion of the upper sheet and has a generally truncated, pyramidal configuration.

Corner pillars 18 include an annular side wall 18*a* and a bottom wall 18*b*.

Intermediate transverse pillars 20 include an annular side wall 20*a* and a bottom wall 20*b*.

Intermediate longitudinal pillars 22 include an annular side wall 22*a* and a bottom wall 22*b*.

Central pillar 24 has a compound configuration and includes a downstanding outer annular wall 24*a*, an upstanding inner annular wall 24*b* joined at its lower annular end to the lower annular end of outer wall 24*a* and positioned concentrically within the outer wall, and a top wall 24*c*.

Lower sheet 14 includes a main body portion 48, raised portions 50, corner pillars 52, intermediate transverse pillars 54, intermediate longitudinal pillars 56, and a central pillar 58.

Main body portion 48 has a generally planar configuration and includes transverse peripheral ribs 60, longitudinal peripheral ribs 62, central transverse ribs 64 and central longitudinal ribs 66.

Raised portions 50 are arranged in quadrants corresponding generally to the quadrants of the areas 44 of the upper sheet and each includes a rectangular top wall 68 elevated above the level of the main body portion and a plurality of spaced upstanding legs 70 connecting the corners of the top wall to the main body portion. The legs 70 splay outwardly from the respective top wall so as to give each raised portion 50 a truncated pyramidal overall configuration. Each top wall 68 includes a plurality of upstanding bosses 72 arranged in staggered rows. Each boss 72 includes an annular side wall 72*a* and a top wall 72*b*.

All of the lower sheet pillars extend upwardly from the main body portion, are hollow, have a generally truncated pyramidal configuration, and open in the lower face of the main body portion.

Corner pillars 52 have an annular side wall 52*a* and a top wall 52*b*.

Intermediate transverse pillars 54 have an annular side wall 54*a* and a top wall 54*b*.

Intermediate longitudinal pillars 56 have an annular side wall 56*a* and a top wall 56*b*, and have a triangular cross-sectional configuration sized and configured to nest in a V groove 22*c* defined in an outboard region of the annular wall 22*a* of the respective downstanding pillar 22.

Central pillar 58 has an annular side wall 58*a* and a top wall 58*b*.

Methodology

In typical twin sheet practice, each of the upper and lower sheets 12 and 14 is formed in a vacuum thermoforming operation and the upper and lower sheets while still in a heated fusible condition are brought together to selectively fuse portions of the upper sheet to portions of the lower sheet to form the pallet.

Figure 4:
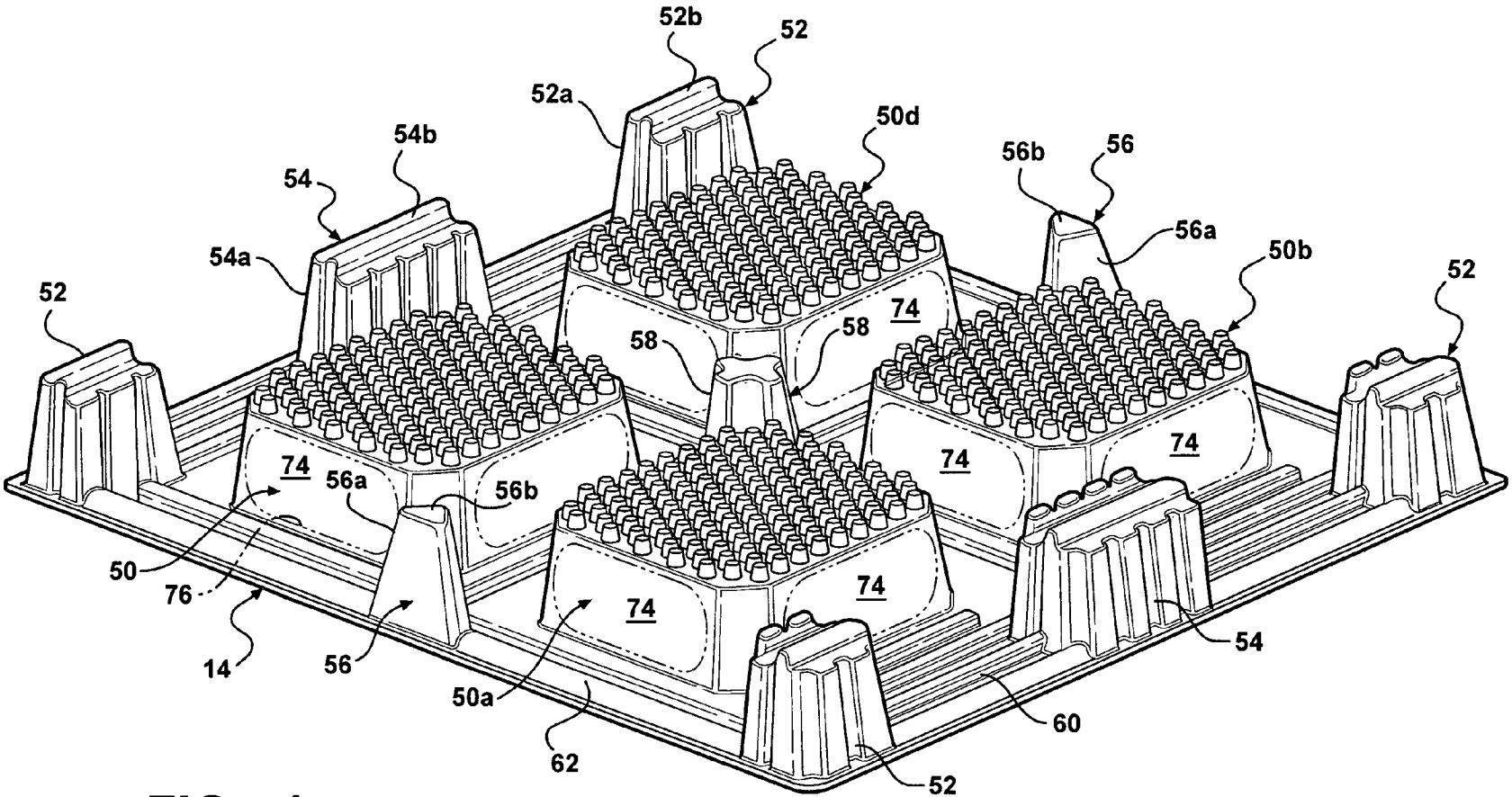
FIG. 4 is a perspective view of a lower sheet of the pallet.
Figure 5:
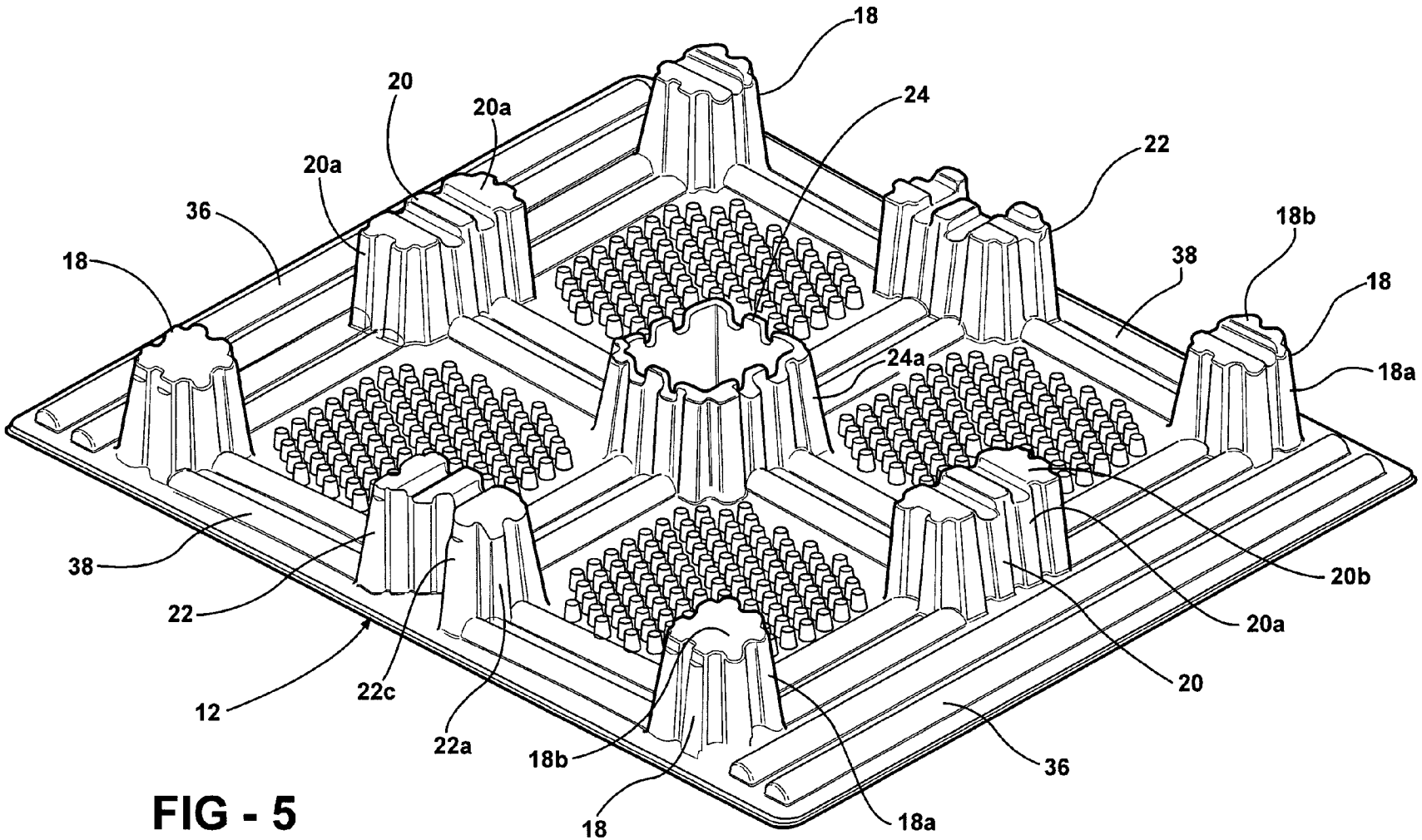
FIG. 5 is a perspective view of an upper sheet of the pallet with the sheet inverted.
Figure 6:
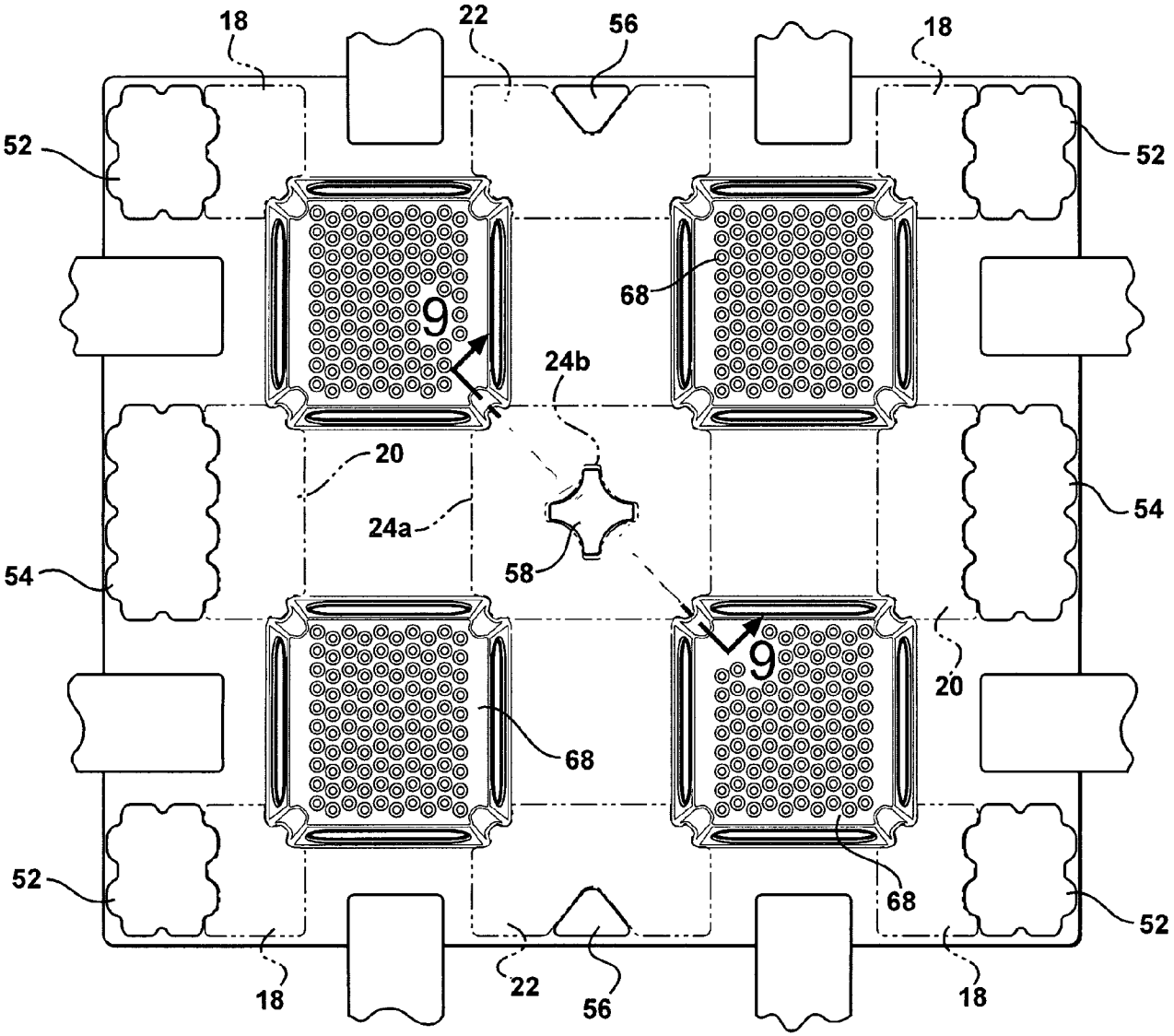
FIG. 6 is a somewhat schematic view showing the lower sheet in solid line and the upper sheet in superimposed dotted line.
Figure 7:
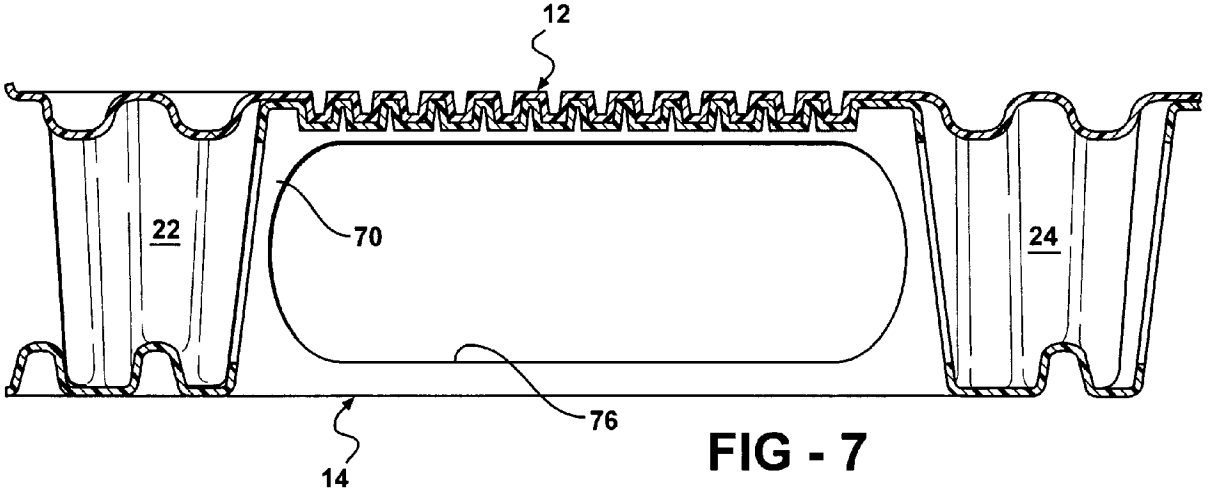
FIG. 7 is a cross-sectional view taken on 1. 7-7 of FIG. 1.
Figure 8:
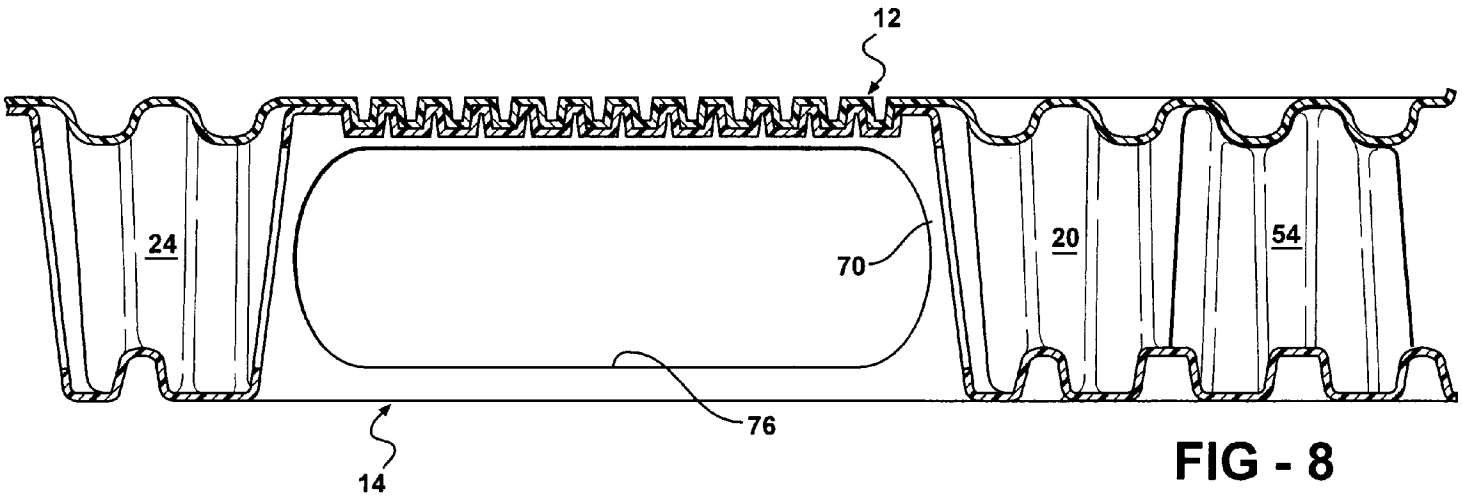
FIG. 8 is a cross-sectional view taken on 1. 8-8 of FIG. 1.
Figure 9:
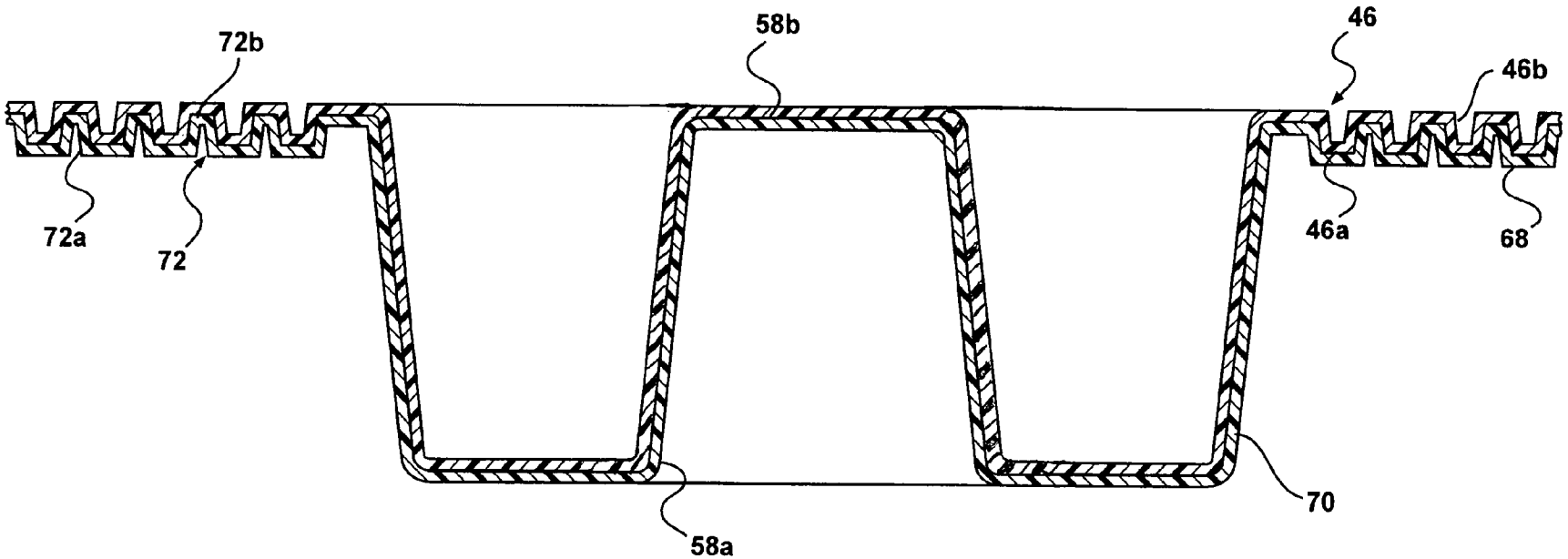
FIG. 9 is a cross-sectional view taken on 1. 9-9 of FIG. 6.

Specifically, the upper sheet is thermoformed to the configuration seen in FIG. 5 and the lower sheet is thermoformed to the configuration seen in FIG. 4. Note that, as initially thermoformed and as seen in FIG. 4, the lower sheet 14 does not define the legs 70 but rather the top walls 68 are connected to the main body of the sheet by solid side walls 74.

As the sheets are brought together while still in a heated fusible condition, corner pillars 18 are positioned inboard of respective corner pillars 52; intermediate transverse pillars 20 are positioned inboard of respective intermediate transverse pillars 54; intermediate longitudinal pillars 22 are positioned inboard of respective intermediate longitudinal pillars 56 with pillars 56 nesting in respective V grooves 22*c*; central pillar 24 is positioned telescopically over central pillar 28; the side walls of the corner pillars 18 fuse with the adjacent side walls of respective corner pillars 52; the side walls of intermediate transverse pillars 20 fuse with the adjacent side walls of respective intermediate transverse pillars 54; the side walls of intermediate longitudinal pillars 22 fuse with the adjacent side walls of intermediate longitudinal pillars 56; the inner annular side wall of central pillar 24 fuses with the annular wall of central pillar 58; the annular side wall of each corner pillar 18 further fuses with the corner defined by the intersection of adjacent side walls 74 of the adjacent raised portion 50; the annular side wall of each intermediate transverse pillar 20 further fuses with the corner defined by the intersection of adjacent side walls 74 of a first raised portion 50 as well as with the corner defined by the intersection of adjacent side walls 74 of an adjacent raised portion 50; the annular side wall of each intermediate longitudinal pillar 22 further fuses with a corner defined by the intersection of adjacent side walls 74 of a first raised portion 50 as well as with the corner defined by the intersection of adjacent side walls 74 of an adjacent raised portion 50; the outer annular wall of the central pillar 24 fuses with corners defined by the intersection of adjacent side walls 74 of all four raised portions 50; the upper walls of the pillars of the lower sheet fuse with the underface of the main body portion of the upper sheet; the lower walls of the pillars of the upper sheet fuse with the upper face of the main body portion of the lower sheet; and the bosses 46 of the upper sheet intermesh with the bosses 72 of the lower sheet with the lower walls of the bosses 46 fusing with the upper face of the top walls 68, the top walls of the bosses 72 fusing with the underface of the areas 44 of the main body portion of the upper sheet, and the side walls of the bosses 46 and 68 also fusing at their interfaces.

Note that ribs are provided on the annular side walls of each of the pillars which intermesh when the sheets are brought together to increase the fused contact area and that further rib configurations are provided on the bottom and top walls of the pillars for meshing with the various ribs 36, 38, 40, 42, 60, 62, 64, 66 in the main body portions of the upper and lower sheets to again increase the fused contact area. Note that the truncated pyramidal configuration of the various upstanding and downstanding portions of the upper and lower sheets allow the sheets to fit together like a jigsaw puzzle with truncated pyramidal surfaces fusing with inverted truncated pyramidal surfaces for maximum fusion interface area and maximum pallet strength.

Following the fusion of the upper sheet to the lower sheet, substantially the entire areas of the side walls 74 of the lower sheet are suitably cut away to form generally rectangular openings 76 which in turn define the legs 70. Note that the legs 70 are formed at the corners formed by the intersection of the adjacent side wall 74 so that, in the completed pallet, the downstanding pillars of the upper sheet are actually fused to legs 70.

It will be seen in the completed pallet the pillar structures defined by the respective fusion of the upper and lower pillars are spaced apart in a manner to be aligned with the openings 76 in the side walls 74 so that the aligned openings 76 and the aligned spaces between the pillar structures coact to define forklift passages extending both transversely and longitudinally of the pallet for use in known manner to facilitate transport of the pallet.

It has been found that the pallet of the invention, by virtue of its simple construction and its use of thin plastic sheeting, can be produced at a cost that renders the pallet feasible for use in one-way applications where the pallet, after fulfilling an initial shipping or material handling assignment, is not reused, but rather is destroyed or recycled after the single use.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A thermoformed twin sheet plastic pallet comprising an upper plastic sheet and a lower plastic sheet, the sheets being fused together to form an upper platform surface and a plurality of fork lift passages, characterized in that:

the upper sheet has a generally planar configuration and includes an upper face defining the platform surface and an underface;

the lower sheet includes a generally planar main body portion and a plurality of spaced raised portions each including a top wall elevated above the level of the main body portion and a plurality of spaced upstanding legs connecting the top wall to the main body portion;

the top walls of the raised portions of the lower sheet are fused to the underface of the upper sheet;

the forklift passages are defined between the spaced upstanding legs of the raised portions of the lower sheet;

each top wall includes a plurality of spaced bosses; and the area of the upper sheet in overlying relation to each top wall includes a plurality of spaced downstanding bosses fused to the upstanding bosses of the respective top wall;

each upstanding boss includes a top wall and an annular side wall;

each downstanding boss includes a bottom wall and an annular side wall;

the top wall of each upstanding boss is fused to the underface of the upper sheet;

the bottom wall of each downstanding boss is fused to an upper face of one of the top walls of one of the raised portions; and the side wall of each upstanding boss is fused to the side wall of at least one downstanding boss.

2. A method of forming a twin sheet plastic pallet comprising:

forming a generally planar upper sheet having a main body portion and a plurality of downstanding pillar portions spaced about the periphery of the main body portion;

forming a lower sheet having a generally planar main body portion and a plurality of raised portions each including a planar top wall spaced above the main body portions of the lower sheet and upstanding side walls interconnecting the top wall and the main body portion of the lower sheet;

fusing the top walls of the raised portions of the lower sheet to an underface of the main body portion of the upper sheet while fusing lower portions of the downstanding pillar portions to the main body portion of the lower sheet in surrounding relation to the raised portions; and cutting away portions of the side walls to define openings in the side walls in alignment with spaces between the downstanding pillar portions to form forklift passages for the pallet.

3. A thermoform twin sheet plastic pallet comprising an upper plastic sheet and a lower plastic sheet, the sheets being fused together to form an upper platform surface and a plurality of fork lift passages, characterized in that:

the upper sheet has a generally planar configuration and includes an upper face defining the platform surface and an underface;

the lower sheet includes a generally planar main body portion and a plurality of spaced raised portions arranged in quadrants centrally of the lower sheet, each raised portion including a top wall elevated above the level of the main body portion and a plurality of spaced upstanding legs connecting the top wall to the main body portion;

the top walls of the raised portions of the lower sheet are fused to the underface of the upper sheet;

the forklift passages arc defined between the spaced upstanding legs of the raised portions of the lower sheet;

the lower sheet further includes a plurality of upstanding pillar portions spaced about the periphery of the main body portion in surrounding relation to and outboard of the raised portions; and the upper sheet further includes a main body portion and a plurality of downstanding pillar portions spaced about the periphery of the upper sheet main body portion and fused to an upstanding pillar portion to form spaced pillar structures.

4. A twin sheet pallet according to claim 3 wherein the side wall of each downstanding pillar portion is further fused to a respective upstanding leg of one of the raised portions.

5. A twin sheet pallet according to claim 4 wherein each upstanding pillar portion includes an upstanding side wall and a top wall fused to the underface of the upper sheet and the side wall of each downstanding pillar portion is fused to the side wall of a respective upstanding pillar portion and a bottom wall of each downstanding pillar portion is fused to an upper face of the main body portion of the lower sheet.

6. A thermoformed twin sheet plastic pallet comprising:

an upper plastic sheet having a generally planar configuration and including an upper face defining a platform surface for the pallet and an underface;

a lower plastic sheet including a generally planar main body portion and a plurality of spaced raised portions each including a top wall elevated above the level of the main body portion and fused to the underface of the upper sheet and a plurality of spaced upstanding legs connecting the top wall to the main body portion and defining forklift passages for the pallet;

the lower sheet further including a plurality of upstanding pillar portions spaced about a periphery of the main body portion in surrounding relation to the raised portion; and the upper sheet having a main body portion at a plurality of downstanding pillar portions spaced about the periphery of the upper sheet main body portion and fused to respective upstanding pillar portions to form paced pillar structures.

7. A twin sheet pallet according to claim 6 wherein the forklift passages arc further defined between the spaced pillar structures.

8. A twin sheet pallet according to claim 7 wherein each upstanding pillar portion includes an upstanding side wall and a top wall fused to the underface of the upper sheet and each downstanding pillar portion includes a side wall fused to the side wall of a respective upstanding pillar portion and a bottom wall fused to an upper face of the main body portion of the lower sheet.

9. A twin sheet pallet according to claim 8 wherein the side wall of each downstanding pillar portion is further fused to one of the upstanding legs of one of the raised portions.

10. A twin sheet pallet according to claim 9 wherein:

the upper sheet further includes a central downstanding pillar portion;

the top walls of the raised portions are positioned in circumferentially surrounding relation to the central downstanding pillar portion; and the central downstanding pillar portion is fused to one of the upstanding legs of each of the raised portions.

11. A twin sheet pallet according to claim 10 wherein:

the central downstanding pillar portion includes a downstanding outer annular wall fused to the upstanding legs and an inner upstanding annular wall positioned within the outer wall; and the lower sheet includes, a central upstanding pillar portion telescopically received within and fused to the inner wall of the central downstanding pillar portion of the upper sheet.

12. A method of forming a twin sheet plastic pallet comprising:

forming a generally planar upper sheet;

forming a lower sheet having a generally planar main body portion and a plurality of raised portions each including a planar top wall spaced above the main body portion and upstanding side walls interconnecting the top wall and the main body portion;

fusing the top walls of the raised portions of the lower sheet to an underface of the upper sheet; and cutting away portions of the side walls to define openings in the side walls defining forklift passages for the pallet;

forming a plurality of upstanding pillar portions spaced about the periphery of the main body portion of the lower sheet in surrounding relation to the raised portions;

forming a plurality of downstanding pillar portions spaced about the periphery of the upper sheet main body portion; and fusing each downstanding pillar portion to a respective upstanding pillar portion to form spaced pillar structures.

13. A method according to claim 12 including the further steps of:

forming each upstanding pillar portion to include an upstanding side wall and a top wall;

forming each downstanding pillar portion to include a downstanding side wall and a bottom wall;

fusing the top wall of each upstanding pillar portion to the underface of the upper sheet;

fusing the bottom wall of each downstanding pillar portion to an upper face of the lower sheet; and fusing the side wall of each upstanding pillar portion to the side wall of a respective downstanding pillar portion to form the spaced pillar structures.

14. A method according to claim 13 wherein the pillar structures are spaced such that the spaces between the pillar structures are aligned with, the openings in the side walls of the raised portions of the lower sheet whereby the forklift passages are defined by the spaces between the pillar structures and the aligned openings in the side walls of the raised portions of the lower sheet.

15. A method according to claim 13 wherein:

the step of cutting away portions of the side walls of the raised portions results in a plurality of upstanding legs connecting the top walls of the raised portions to the main body portion of the lower sheet; and the method includes the further step of fusing the side wall of each downstanding pillar portion to a respective upstanding leg.

* * * * *